United States Patent [19]

Nocera et al.

[11] Patent Number: 4,788,991

[45] Date of Patent: Dec. 6, 1988

[54] HAIR PIECE

[76] Inventors: Paula K. Nocera, 104 E. 37th St., New York, N.Y. 10016; Bernd P. Hopp, 21 Oak Rd., Saddle River, N.J. 07458

[21] Appl. No.: 93,774

[22] Filed: Sep. 8, 1987

Related U.S. Application Data

[63] Continuation-in-part of Ser. No. 834,584, Feb. 28, 1986, abandoned.

[51] Int. Cl.[4] ..... A45D 24/00; A41G 3/00

[52] U.S. Cl. ..... 132/156; 132/53; 132/157; 132/273

[58] Field of Search ..... 132/46 R, 48 R, 50 R, 132/53, 54, 156, 157, 159

[56] References Cited

U.S. PATENT DOCUMENTS

| | | | |
|---|---|---|---|
| 1,346,718 | 7/1920 | Muller | 132/53 |
| 1,714,358 | 5/1929 | Finkelstein | 132/53 |
| 1,845,380 | 2/1932 | Westmore | 132/53 |
| 2,490,285 | 12/1949 | Smith | 132/159 |
| 2,523,924 | 9/1950 | Sawyer | 132/157 |
| 2,547,295 | 4/1951 | Weeks | 132/157 |
| 2,844,154 | 7/1958 | Solomon | 132/48 R |
| 2,929,386 | 3/1960 | Behr et al. | 132/156 |
| 2,989,058 | 6/1961 | Freyer et al. | 132/48 R |
| 3,209,768 | 10/1965 | Goodman | 132/46 R |
| 3,433,235 | 3/1969 | Doolittle | 132/53 |
| 3,485,249 | 12/1969 | Mast | 132/53 |

FOREIGN PATENT DOCUMENTS

| | | | |
|---|---|---|---|
| 339370 | 5/1919 | Fed. Rep. of Germany | 132/159 |

*Primary Examiner*—Allen M. Ostrager
*Attorney, Agent, or Firm*—Myron Amer

[57] ABSTRACT

Natural or synthetic hair is attached to a semi-spherical stretchable net-like fabric body to the circumferential end of which is attached a flat, flexible and stretchable serpentine comb. Upon attachment to the circumferential edge, the comb assumes a circular configuration wherein the tines extend radially and the comb lies substantially flat in the plane of the circumferential edge of the body.

1 Claim, 2 Drawing Sheets

HAIR PIECE

This is a continuation-in-part of application of Ser. No. 834,584 filed on Feb. 28, 1986 which is now abandoned.

The present invention relates generally to wigs, and more particularly a novel comb attached to the underside of the wig which, when engaged with the user's natural hair, is effective in holding the wig in place.

PRIOR ART

The most popular combination wig and comb of this character are those which use the comb component thereof to engage with the user's natural hair and in this manner secure the wig in place. However, the prior art combs that are used on wigs for the purposes just noted are usually not effective in establishing a firm grip on the user's natural hair so as to prevent inadvertent shifting movement, or even disengagement, of the wig. This undoubtly is because the prior art combs does not generate any holding or engaging force on its own, but must rely on there being a significant amount of natural hair to provide a corresponding significant engagement with the tines of the the comb to maintain the wig in its proper place. Obviously, if there is an insufficient amount of natural hair, which is often the case and is the reason for wearing the wig, it is not possible to firmly secure the wig in place.

EXAMPLES OF PRIOR ART

U.S. Pat. No. 3,433,235 issued on Mar. 18, 1969 to Doolittle describes a semi-spherical wig which is releasably secured to the user's hair by a comb which is attached to the wig. The comb, however, is of conventional construction and the force with which it establishes engagement is a function of the quantity or amount of the user's hair. In other words, if there is little natural hair, the Doolittle comb is ineffective in firmly holding the wig in place.

U.S. Pat. No. 1,346,718 issued on July 13, 1920 to Muller also describes a combination wig and comb, in which the comb is attached to a circumferential edge of the wig. Here also, however, the firmness by which the wig is held in place in achieved by the comb, and the comb, in turn, will hold the wig firmly in place only if there is an abundant amount of natural hair to achieve this result.

U.S. Pat. No. 2,547,295 issued on Apr. 3, 1951 to Weeks is related to a hair retaining devise, designated 10 therein which is capable of expanding and contracting and is used by Weeks in much the same manner as a headband. That is, it is described as being worn flat on the outside of the user's hair and in this position holding the user's hair in place. This expandable and contractable devise of Weeks is, however, provided, at least in one embodiment, with points along one edge which are capable of being inserted, and thereby engaging with, the natural hair of the user. This function is never realized however since, as already noted, the band 10 of Weeks is illustrated and described as being worn flat and in an unengaged condition with respect to the natural hair of the user.

It is desirable to provide a combination comb and wig in which the comb component is operable in generating a holding force to the natural hair of the user, separate and apart from the fact that the tines of the comb are inserted into the natural hair. In this manner, even if there is less natural hair than is desirable, the additional holding force alluded to, which is generated in the comb component, is thus capable of providing a firm engagement for the wig, and thus preventing shifting and even disengagement thereof.

The present invention is thus a wig that has a comb capable of firmly attaching the wig to the user's natural hair. This is achieved by using a comb that is in a closed loop configuration and one which is expandable and contractable because of its elastic plastic construction material. An outer edge of the comb loop is attached to a peripheral wig edge such that the inner edge is disposed inwardly, and has an appropriate shape for being inserted and engaging in the natural hair of the user. In use, the comb loop is stretched into a large circle, the tines are provided with an initially engaged position with the natural hair of the user, and then the enlarged loop is released so that it can contract, and in undergoing the contraction forces the tines securely into the user's natural hair. It should be noted that to allow for the expansion and contraction of the comb loop, that the hair of the wig is knotted or otherwise appropriately attached to the fabric body which is stretchable to the same extend and degree as the plastic comb component.

Full details of the present invention are set forth in the following disclosure and illustrated in the accompanying drawings.

DESCRIPTION OF THE INVENTION

Figure 4:
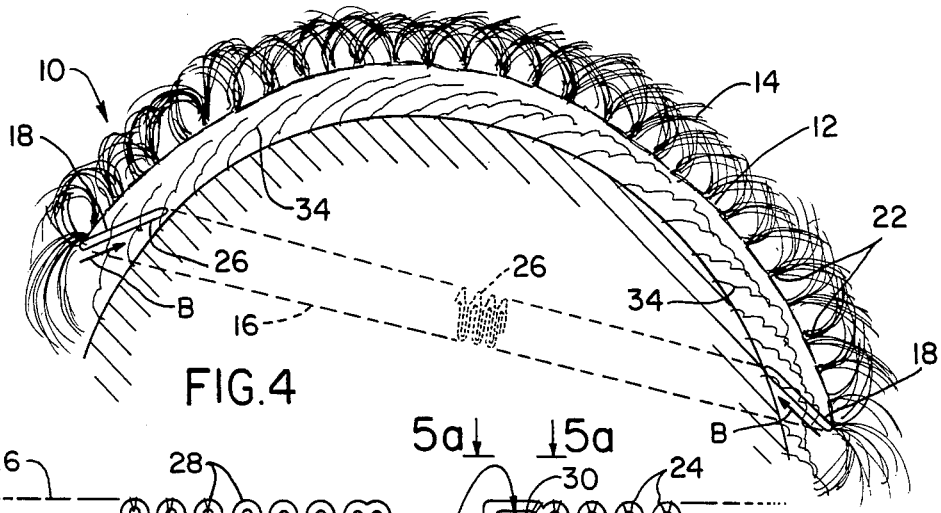
FIG. 4 is a sectional view along the lines 4—4 of FIG. 1 showing the engagement of the tines within the natural hair of the wearer.
Figure 5:
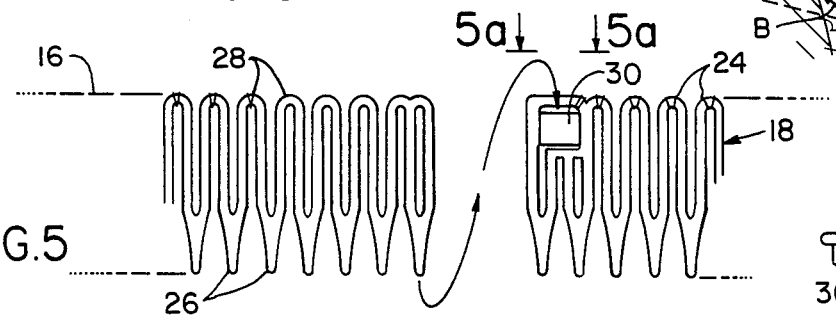
FIG. 5 is a flat developmental view of the comb showing its connecting ends.
Figure 5A:
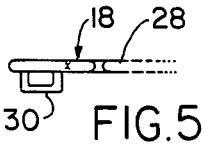
FIG. 5*a* is a side elevational view of the end of the comb taken in the direction of line 5*a*—5*a* of FIG. 5.

As illustrated in the drawings, the wig, generally depicted with the numeral 10, comprises an elastic body 12 to which is attached a mass of hair, generally depicted by the numeral 14. The net body 12 as seen in FIG. 4 has a generally semi-spherical configuration, even in relaxed condition, defining a dome or crown having a relatively constricted circumferential edge 16, to which a flexible, stretchable comb 18, is attached.

The net body 12 is preferably formed of elastic thread, which is knit so as to form a fabric consisting of a plurality of interconnecting loops 20. Other ways for forming an elastic net may be employed, as by weaving or the like, provided the same has individual loops. The fabric net body 12 may be shaped to conform to that of the human head, although this is also not necessary, as an elastic net has multidirectional stretchability and even without specific shaping, a semi-spherical elastic net body will conform easily to a wearer's head in both size and shape.

Figure 1:
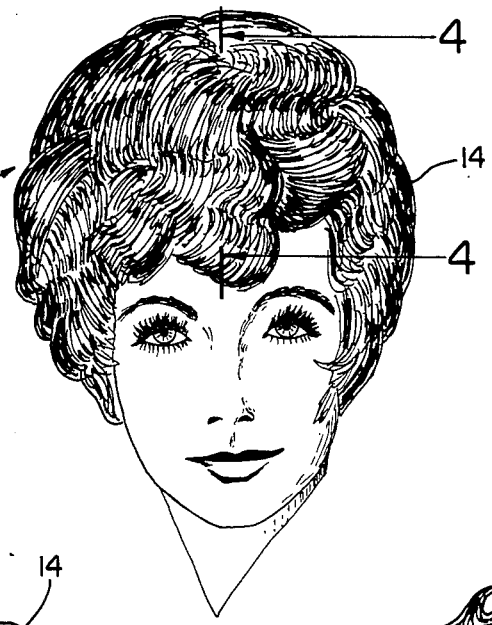
FIG. 1 is a front elevational view showing the wig of the present invention on the head of the wearer.

The hair 14 is applied in individual tufts 22 to individual loops 20 of the net body 12 preferably by knotting the tufts 22 to the loops. Should both synthetic hair and synthetic net threads be employed, the tufts 22 may be heat sealed to the loops, rather than being knotted. The amount of hair in each tuft 22 and the number of tufts employed is selected so that desired hair style and density of hair is obtained, as for example, as seen in FIG. 1. Of course, the length of hair in each tuft 22 and the number of tufts arranged in any given section of the net body will also be selected, so that when the wig is finally completed and place on the head, the wig covers the head in a realistic and desirable coiffure.

Figure 3:
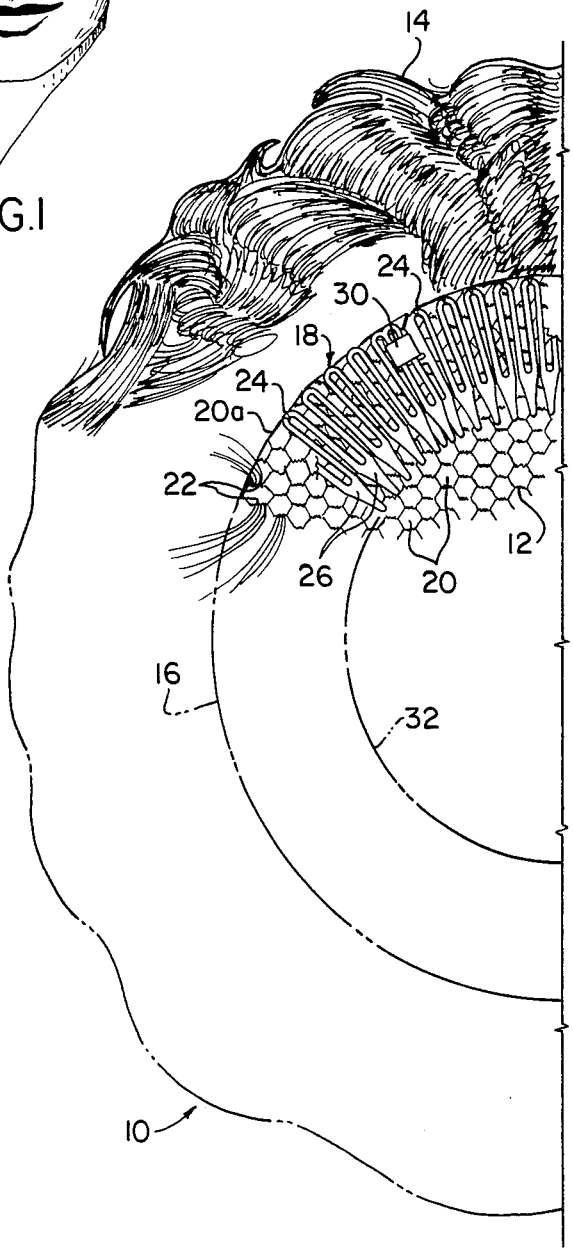
FIG. 3 is a bottom view of the wig shown in FIG. 2.
Figure 6:
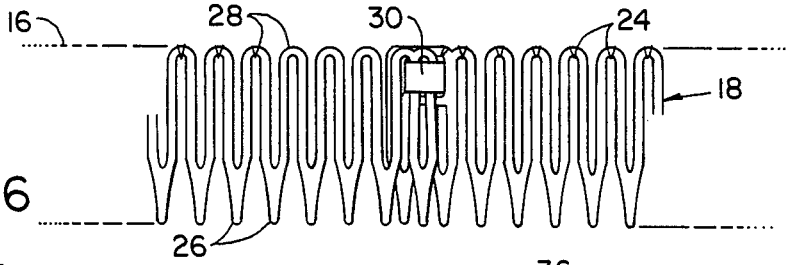
FIG. 6 is a view similar to that of FIG. 5 showing the ends of the comb interengaged.
Figure 7:
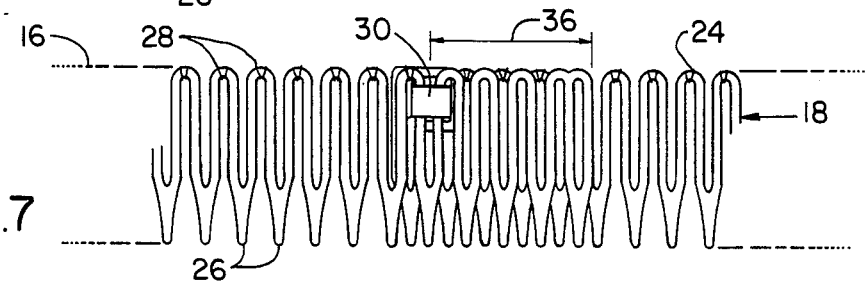
FIG. 7 is a view similar to that of FIG. 6 showing the ends of the comb interengaged to produce a smaller circumference.
Figure 8:
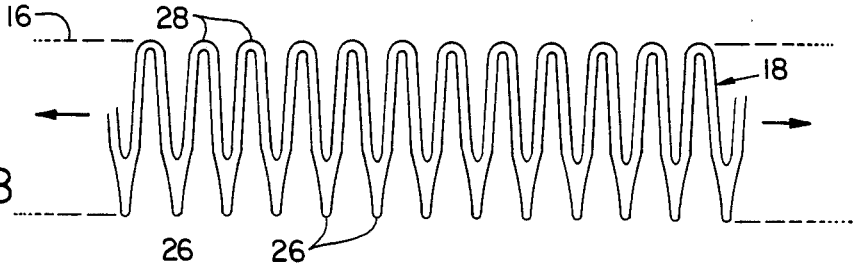
FIG. 8 is a plan view of the comb in stretched condition.

The circumferential edge of the net body 12 preferably consists of reinforced loops 20*a* (FIG. 3) some of which are selected to be attached by stitches 24 or other means to the elongated flexible and stretchable comb 18. The comb 18 preferably formed of plastic, although aluminum, bone or other material can be used, and comprises a flat strip formed in a serpentine pattern to have a plurality of tines 26 spaced along its length and individually interconnected by bases 28. The tines 26 are preferably shaped to have pointed ends to facilitate their entry into the wearer's natural hair 34 (FIG. 4). One end of the flat comb 18 is formed with a hasp 30 on one surface which is sufficiently wide to receive at least one of the tines 26, so that by placing a tine at the opposite end of the comb, into the hasp 30, a continuous circular comb is formed. As seen in FIGS. 6 and 7, by selecting the specific tine at the end opposite that having the hasp for engagement into the hasp 30, a selected adjustment of the circumference can be obtained. As an option, comb 18 can be molded as a closed loop, and thus the hasp 30 can be omitted.

Figure 2:
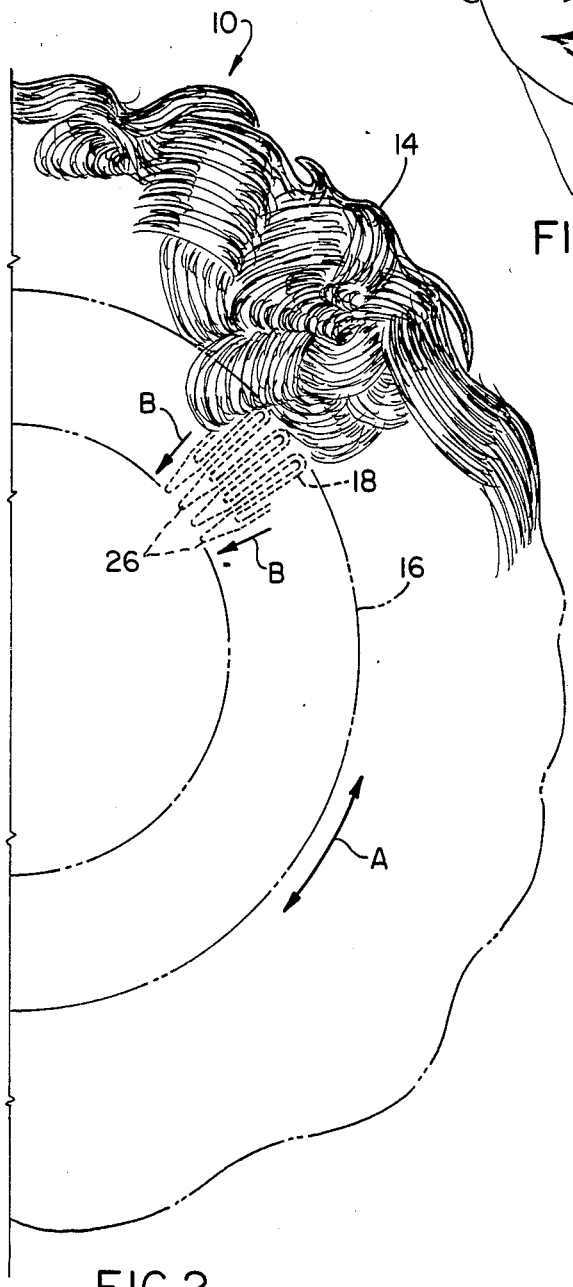
FIG. 2 is a partial plan view of the wig shown in FIG. 1.

The comb 18 is attached to the net body 12 by stitching individual bases 28 of the comb 18 to individual ones of the reinforced loops 20*a* along the circumferential edge 16, so that the comb 18 is slightly stretched. As a result, the comb 18 in its relaxed condition is slightly shorter than the length of the circumferential edge 16 of the net body 12 to which it is attached. As a result, the comb 18 will be slightly stretched along a circular line defined by the edge 16 connecting its bases 28, relative to the concentric line 32 connecting the tines 26. In this manner, the comb 18 is provided with a slight longitudinal tension at its bases 28 causing the tines 26 to assume a radially directed position to point slightly inward toward the center of the edge 16 and its concentric line 32. This places a further torque-like tension as noted by arrow A in FIG. 2 on the tines 26 biasing the comb inwardly of the net body at a reentrant angle, noted by arrows B in FIG. 4, with respect thereto wherein the comb 18 takes a substantially flat but circular position in the plane of the edge 16, as can be seen in FIG. 4. Consequently, when the net body 12 and the comb 18 is further stretched for placement on the head of the wearer, the resultant force on the comb as a whole increases the angle and force exerted on the tines 26 resulting in a forceable entry of the tines 26 into the hair of the wearer at a relatively shallow angle to the scalp as seen in FIG. 4.

The wig 10 of the present invention is easily placed on the head of the wearer, since both the net body 12 and the comb 18 are both bendable, and stretchable. The user stretches the comb 18 to a larger diameter (simultaneously stretching the body 12) placing it in the approximate location for attachment to her own hair, then merely releases the comb 18 to achieve attachment. The urgency provided by the configuration and the resiliency of the construction of the comb causes a change from the larger stretched diameter to a smaller or reduced diameter. Thus movement of the tines 26 is generally circumferentially inward, but because of the continually larger circumferences at the bases 28 of the comb 18 than at the tines 26, the tines maintain a radially inward direction and move inwardly at a reentrant angle to the plane in which lies the edge 16 of the net body 12. this inward and reentrant angle movement projects the tines 26 of the comb 18 into the user's natural hair and thus effectively attaches the wig in place in a comfortable, but yet secure manner. Subsequent adjustment is easily permitted by either stretching the comb along its entire circumference, or by selective manipulation and maneuvering of portions of the circumferential edge. Hair pins, clips or other devices for holding the wig in place are not necessary.

Since the comb 18 holds the wig 10 firmly in place, the wig will not dislodge or skew during use. The wearing of a hat by the user, or even the inadvertent touching of the wig by another would not dislodge the wig from its fixed position.

Various changes and modifications have been described. Other changes, modifications and indeed embodiments will be obvious to those skilled in this art. Accordingly, it is intended that the present disclosure be taken as illustrative only and not limiting of the invention.

What is claimed is:

1. A wig comprising a semi-spherical stretchable fabric net body formed of a plurality of interconnected loops having hair attached thereto and having a circumferential edge formed of reinforced loops stretchable with respect to each other, and a flat serpentine comb in a closed loop configuration having an outer circumference and an inner circumference and an expandable body between said outer and inner circumferences having a direction of expansion lengthwise of said comb body, said comb having teeth formed along said inner circumference and interconnecting bases along said outer circumference, said flat comb in said closed loop configuration attached at its bases to selectively spaced peripheral loops of said fabric body so as to be circumferentially tensioned to project said teeth radially inwardly toward the center of said fabric body and be stretchable conjointly with the circumferential edge of said fabric body, whereby preparatory to use, said comb is stretched lengthwise of its expendable body and said unattached inner circumference thereof is inserted into the hair of the user so as to permit corresponding insertion of said teeth into the user's hair, and then said stretched comb is released such that the circumferential tension therein urges the engagement of the teeth of said comb into the user's hair to thereby secure the wig in place

* * * * *